US007040515B2

(12) United States Patent
Cote

(10) Patent No.: US 7,040,515 B2
(45) Date of Patent: May 9, 2006

(54) BOTTLE CAP

(75) Inventor: Cameron A. Cote, Cochrane (CA)

(73) Assignee: Cactrus Drink Systems Inc., Cochrane (CA)

( * ) Notice: Subject to any disclaimer, the term of this patent is extended or adjusted under 35 U.S.C. 154(b) by 0 days.

(21) Appl. No.: 10/707,156

(22) Filed: Nov. 24, 2003

(65) Prior Publication Data

US 2005/0109800 A1 May 26, 2005

(51) Int. Cl.
*B67D 3/00* (2006.01)

(52) U.S. Cl. ..... 222/481.5; 222/185; 222/482; 222/484

(58) Field of Classification Search ..... 222/481.5, 222/482, 484, 351, 185; 141/351
See application file for complete search history.

(56) References Cited

U.S. PATENT DOCUMENTS

| | | | | |
|---|---|---|---|---|
| 2,476,587 | A | 7/1949 | Doblin | |
| 3,540,402 | A | 11/1970 | Kocher | |
| 3,739,938 | A | 6/1973 | Paz | |
| 4,081,111 | A * | 3/1978 | Sandow | 222/309 |
| 4,722,463 | A * | 2/1988 | Anderson | 222/185.1 |
| 4,924,921 | A | 5/1990 | Simmel et al. | |
| 5,413,152 | A | 5/1995 | Burrows | |
| 5,431,205 | A | 7/1995 | Gebhard | |
| 5,676,186 | A | 10/1997 | Vanderploeg | |
| 5,676,278 | A | 10/1997 | Beyer et al. | |
| 5,755,269 | A | 5/1998 | Venooker et al. | |
| 5,758,700 | A | 6/1998 | Vanderploeg | |
| 5,848,736 | A * | 12/1998 | Boumann | 222/185.1 |
| 5,927,565 | A * | 7/1999 | Paczonay | 222/484 |
| 6,378,742 | B1 | 4/2002 | Rohr et al. | |
| 6,527,145 | B1 * | 3/2003 | Bennett, Jr. | 222/185.1 |
| 6,612,468 | B1 * | 9/2003 | Pritchett et al. | 222/190 |

FOREIGN PATENT DOCUMENTS

| | | |
|---|---|---|
| DE | 1 227 796 | 10/1966 |
| EP | 0340940 | 11/1989 |
| WO | WO 03/016164 | 2/2003 |

OTHER PUBLICATIONS

PCT/CA2004/001939 International Search Report Mar. 8, 2005 Cactrus Drink Systems Inc. et al.

* cited by examiner

*Primary Examiner*—Michael Mar
*Assistant Examiner*—Sonia N. Khaira
(74) *Attorney, Agent, or Firm*—Bennett Jones LLP

(57) ABSTRACT

A bottle cap is resealable by a valve housed therein. The valve controls flow through both a liquid flow passage and an air supply passage, while maintaining the passages separate. The valve can be actuated by a feed tube spike.

13 Claims, 3 Drawing Sheets

BOTTLE CAP

BACKGROUND OF INVENTION

The invention relates to bottle cap for closing a bottle and, in particular, a bottle cap for dispensing liquids therethrough without removing the bottle cap from the bottle.

Recently beverage dispensers have been disclosed that are functional to dispense water from a water cooler configuration and also to dispense juice-type beverages from a system that mixes a flavored concentrate with water from the water cooler. One such beverage dispenser is described in PCT application PCT/CA02/00328, filed Mar. 12, 2002.

The beverage concentrate is most conveniently contained in a bottle that includes a mouth opening. The bottle is inverted in the dispenser to allow liquid concentrate to drain or be drawn therefrom. It is desirable therefore that the bottle be invertible, with its mouth pointing down by gravity, for installation in the machine without releasing its liquid contents through the mouth. It is also desirable that a bottle be removable from the dispenser without, again, spilling liquid, such as residual contents, therefrom.

SUMMARY OF INVENTION

A bottle cap is disclosed that can be installed to close the mouth of a bottle, but can be manipulated to open the bottle, to release the bottle contents therefrom, while the cap can remain on the mouth of the bottle.

Thus, in accordance with one embodiment, there is provided a bottle cap for fitting on a bottle including a mouth and an inner volume, the bottle cap comprising: a cover securable over the bottle mouth, the cover having an outer surface and an inner surface; a valve housing extending from the cover inner surface and positioned to be open to the bottle inner volume when the cap is secured over the mouth; a liquid flow port passing through the valve housing and the cover extending between a first opening on the valve housing and a second opening on the cover outer surface; a plunger disposed in the valve housing and moveable between a sealing position blocking liquid flow from the first opening to the second opening of the liquid flow port and an open position permitting liquid flow from the first opening to the second opening of the liquid flow port, the plunger including an drive end accessible though the second port and the plunger being biased into the blocking position but movable into the open position by applying force against the drive end.

In accordance with another embodiment, there is provided a bottle cap comprising: a cap body including a cover surface and a housing, the housing extending opposite the cover surface; a bore in the cap body and opening on the cover surface; a port opening through the housing into the bore and a plunger in the bore and including a drive end accessible through the opening, the plunger biased toward the opening but prevented from passing therethrough, the plunger when biased sealing across the port but drivable by applying force to the drive end to move the plunger to open the port, the cap body formed to fit over a mouth of a bottle with the housing extending into the bottle.

In accordance with another embodiment, there is provided a bottle cap comprising: a cap body including a cover surface and a housing, the housing extending opposite the cover surface; a bore in the cap body and opening on the cover surface; a liquid flow port passing through the cap body between a first opening on the housing and a second opening on the cover surface; an air flow port passing through the cap body separately from the liquid flow port, the air flow port extending between an inside opening on the housing and an outside opening on the cover surface, the cap body formed to fit over a mouth of a bottle with the housing extending into the bottle.

In accordance with another embodiment, there is provided a bottle cap for fitting on a bottle including a mouth and an inner volume, the bottle cap comprising: a cover securable over the bottle mouth, the cover having an outer surface and an inner surface; a housing extending from the cover inner surface and positioned to be open to the bottle inner volume when the cap is secured over the mouth; a liquid flow port passing through the housing and the cover extending between a first opening on the housing and a opening on the cover outer surface; an air flow port passing through the housing and the cover extending between an inside opening on the housing and an outside opening on the cover outer surface.

DETAILED DESCRIPTION

Figure 1:
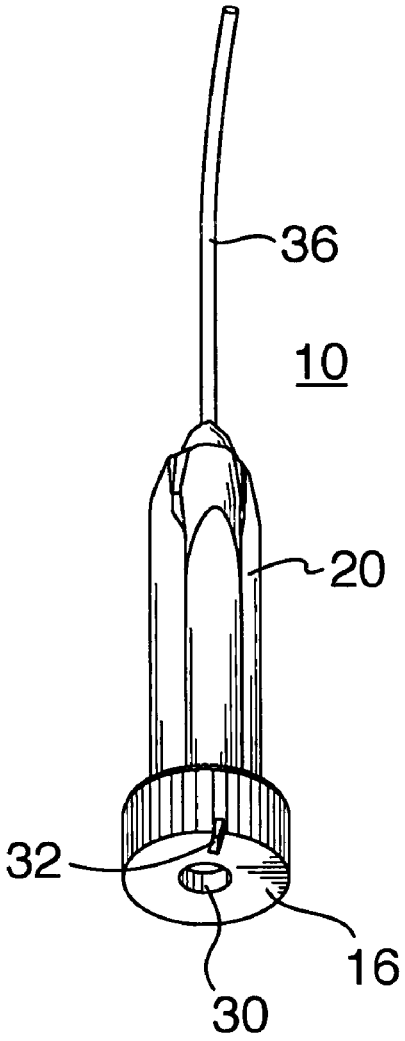
FIG. 1 is a perspective view of a bottle cap according to one embodiment.

Referring to the FIGS. 1 to 5, one embodiment of a bottle cap 10 is shown. The bottle cap is useful to cap the mouth 12 of a bottle 14. When the inner volume 15 of the capped bottle 14 contains a liquid, the liquid can be dispensed through the cap, while the cap remains secured over the mouth of the bottle.

Bottle cap 10 includes a cover 16 including threads 18 or other means such as snap fixtures, etc. on its inner surface for its securing over the bottle mouth. The cover can be selected to reversibly detach from the bottle or alternately, the cover can be formed to be permanently fixed on a bottle by other means such as polymeric welding, fusing, adhesives, etc. Cover 16 can include outer knurling or striations, as shown, to facilitate grasping thereof.

Bottle cap 10 further includes a valve housing 20 secured or formed integral with the cover 16 and extending from the inner surface of the cover. The valve housing is configured relative to the cover such that it will be disposed in communication with the bottle inner volume when threads 18 are secured to the bottle mouth. In the illustrated embodiment, the valve housing extends through the bottle mouth and into the inner volume.

Valve housing 20 includes a liquid flow passage 22, an air supply passage 24 and a plunger 26. The plunger is disposed in the valve housing to act as a valve to control flow through both of the liquid flow passage and the air supply passage. Liquid flow passage 22 extends to provide passage between one or more ports 28 opened on the valve housing and a port 30 opened on cover 16. Air supply passage 24 extends through the cap from an opening 32 on the cover to an opening 34 on the valve housing.

Port 30 and opening 32 can be positioned anywhere on the cover. In the illustrated embodiment, they are positioned separately such that the air supply does not need to flow up through the liquid. As will be appreciated, port 30 can best be employed when it is accessibly positioned on the cover.

Both port 28 of the liquid flow passage and opening 34 of the air supply passage are positioned on the outer surface of the valve housing such that they are positioned in communication with or within the bottle inner volume when the cap is positioned on a bottle. A groove 35 can be formed on the housing outer surface leading to port 28 so that a space is provided between the housing outer surface and a narrow bottle mouth for access to the ports 28. As such, liquid flow passage 22 can allow a flow of liquid from the bottle while air supply passage 24 permits air passage from the air supply opening of the cover to the bottle inner volume to prevent an air lock from developing in the bottle. To extend air supply passage 24, a tube 36 can be secured at opening 34. An o-ring 37 can be used to seal about tube 36 where it is installed in opening 34. Tube 36 can be of a length selected with consideration as to the bottle dimensions so that the tube extends to or adjacent the base of the bottle. By use of tube, air need not bubble up through the bottle contents. This can avoid the formation of bubbles at the interface of the air and the liquid, avoids unnecessary mixing of the bottle contents and avoids contamination of liquid by bubbling air passing up through the bottle contents.

Plunger 26 is disposed in a bore 38 formed in the valve housing and is axially slidable in the bore. Plunger 26 is biased, as by a spring 40, to a sealing position wherein the plunger seals both liquid flow passage 22 and air supply passage 24. Spring 40 is mounted between a shoulder 41 on the plunger and a step 42 in the bore. A contact portion 44 of the plunger is accessible through port 30 such that force can be applied thereto to drive the plunger against the biasing force of spring 40, to move it axially in the bore away from a sealing position in passage 22 and air supply passage 24, such that these passages are opened.

In the illustrated embodiment, port 28 opens into bore 38 and the bore is aligned with port 30 through the cover. In bore 38 between port 28 and port 30, a seat can be formed by an o-ring 46. The plunger includes an end 26*a* that can be sized to extend a length greater than port 28 and configured to be stopped and sealed against o-ring 46. As such, when plunger 26 is biased down against the seat formed by o-ring 46, the plunger plugs passage 22 and seals against liquid flow therethrough. Plunger 26 carries an o-ring 48 positioned with consideration as to the length of ports 28 and with consideration as to the position of the plunger when in the plugging position, to seal between the bore and the plunger above ports 28. While ports 28 are shown adjacent to inner surface of cover 16, it will be appreciated that the ports can be spaced further from the cover, if desired. It is also to be noted that the seat against which the plunger is biased could be formed in other ways and of other materials, as desired.

Plunger 26 at its opposite end controls the flow through air supply passage 24. In particular, in the illustrated embodiment, the air supply passage 24 opens to bore 38 at an opening 50 isolated, as by seals, from liquid flow passage 22. Air supply passage 24 then exits the bore at bore enlargement 52. Opening 50 is spaced a known distance from enlargement 52. To control flow through the air supply passage, plunger 26 is formed as a spool valve including o-rings 56, 58 positioned on the ends of an area of reduced diameter forming the spool neck 59. In the bore, o-rings 56, 58 seal against the bore wall, while the outer surface of spool neck 59 is spaced from the bore wall to create an annulus 60 thereabout. When the plunger is biased in the sealing position, o-ring 58 is in a sealing position between opening 50 and enlargement 52. The air passage is, therefore, sealed, since air cannot move past o-ring 58. However, when plunger 26 is moved against the biasing force in spring 40, this positions the o-rings 56, 58 so that spool neck 59 is open to both opening 50 and enlargement 52 so that air can move along passage 24, including through annulus 60 between the necked portion and the wall of bore 38. O-ring 56 tends to prevent fluid from passing into the spring-containing portion of the bore, which is particularly useful should liquid pass through tube 36.

It will be appreciated therefore, that plunger 26 is biased to seal against flow either into or out of the bottle through cap 10, when the bottle cap is positioned on the bottle with no force applied against contact portion 44. However, the plunger can be moved to open fluid passages 22, 24 by applying pressure against the plunger to move it axially away from port 30. The positions of ports 28 and enlargement 52 can be selected along with plunger end 26*a* and o-ring 58 so that the air supply passage 24 is opened after, and closed before, liquid flow passage 22 to further control the flow of liquid from the bottle.

Figure 2:
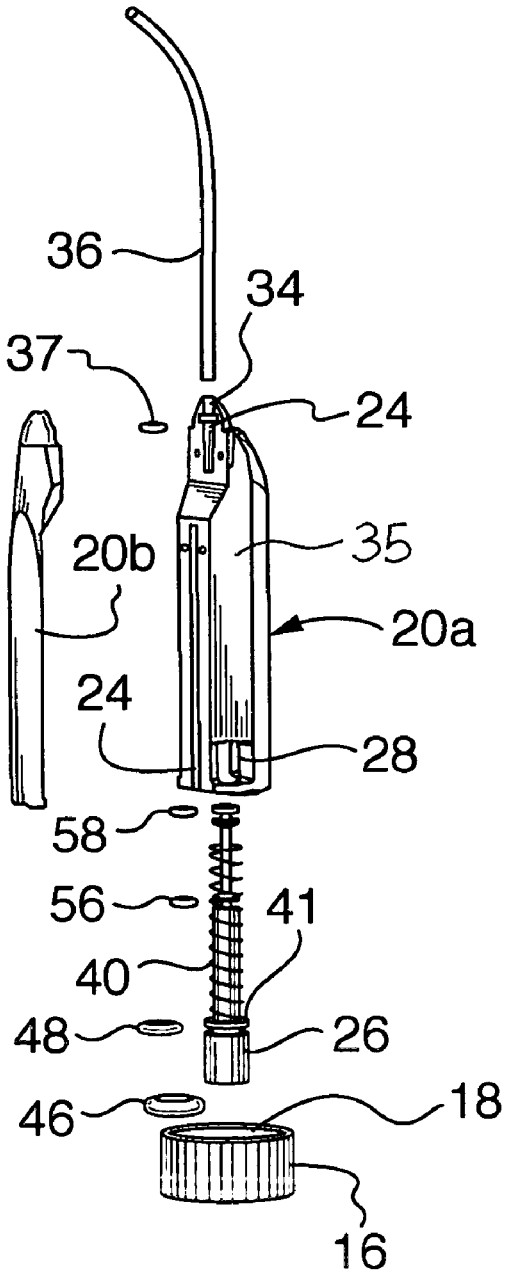
FIG. 2 is an exploded view of the bottle cap of FIG. 1.
Figure 3:
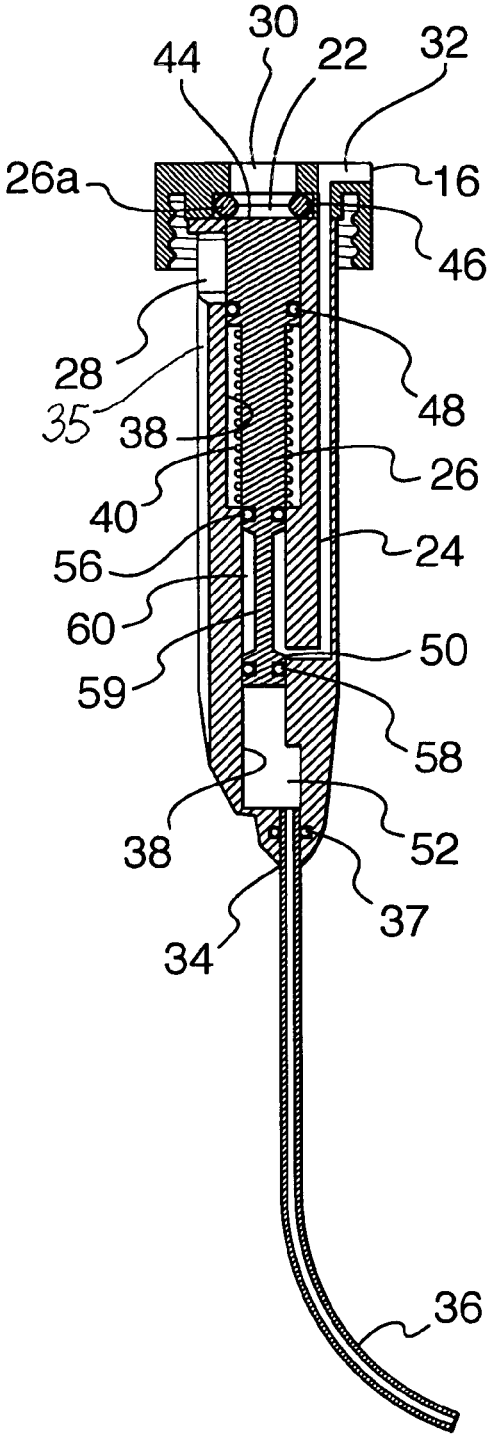
FIG. 3 is a sectional view along line 1—1 of FIG. 1 with the plunger in a first position.
Figure 4:
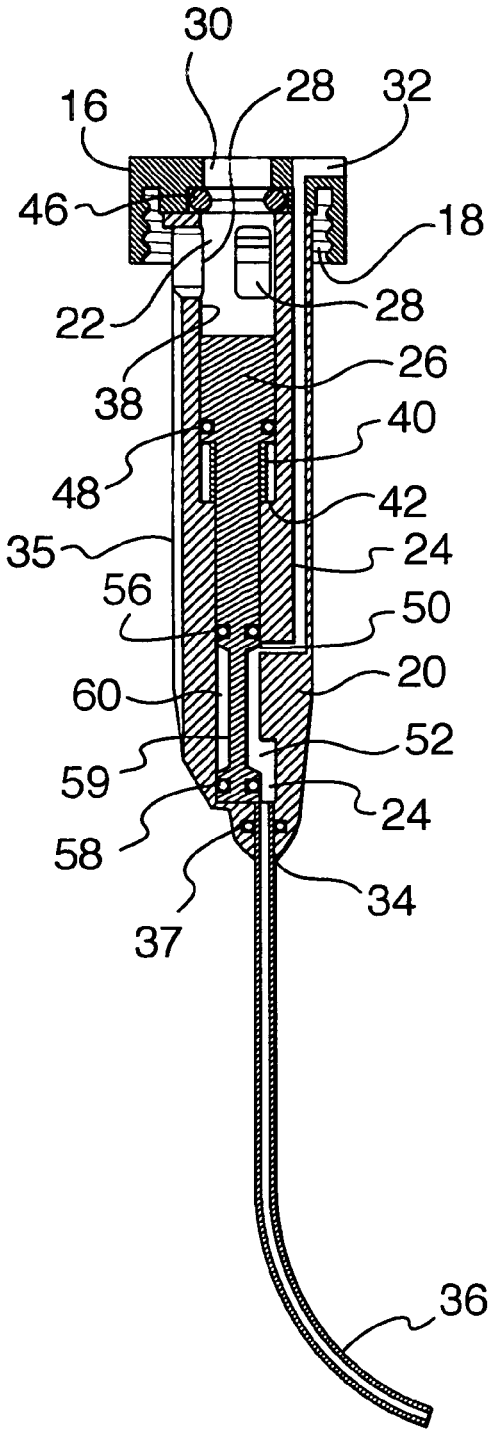
FIG. 4 is a sectional view corresponding to FIG. 3 showing the plunger in the second position.
Figure 5:
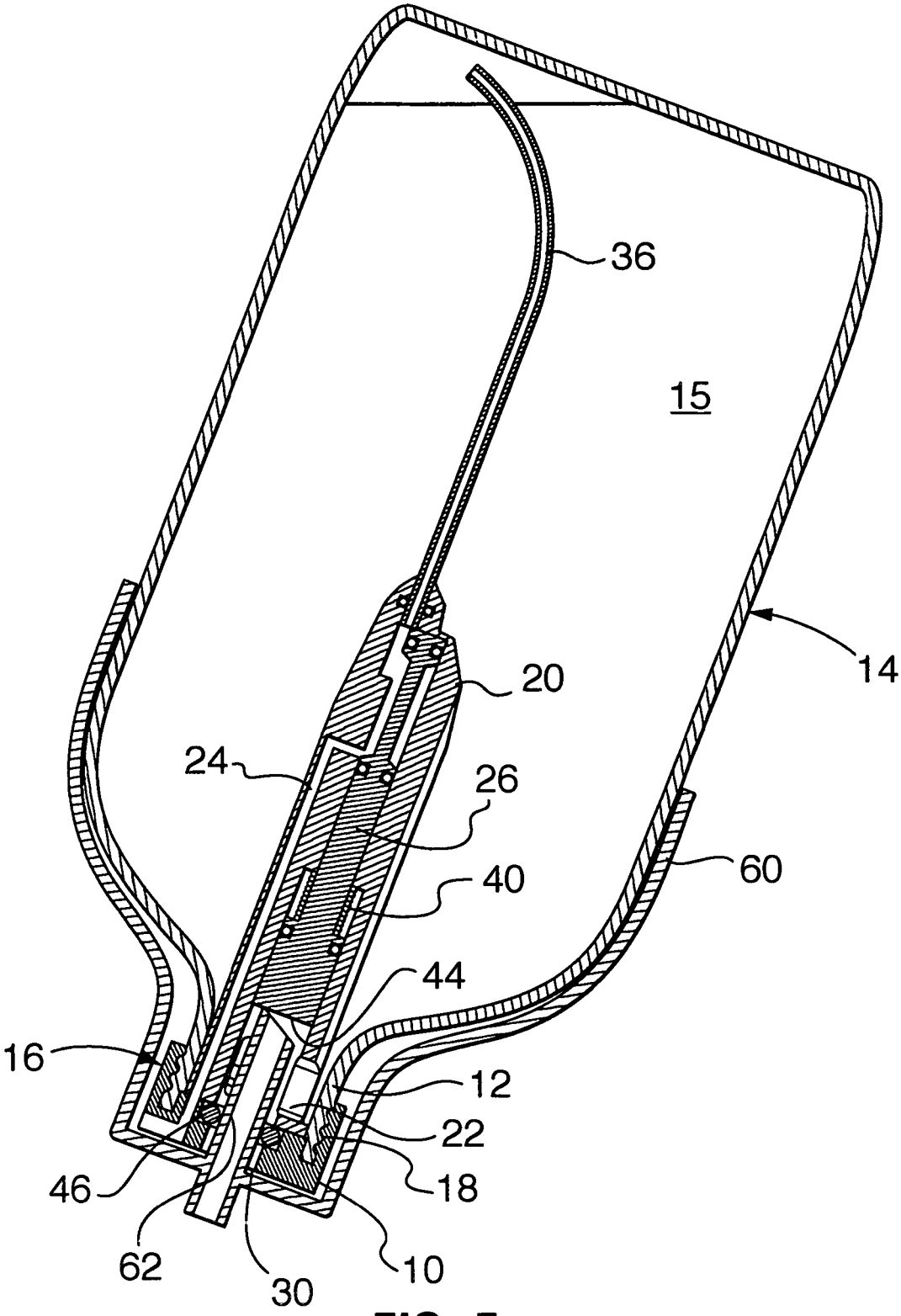
FIG. 5 is a sectional view of a bottle including a bottle cap secured over its mouth and mounted over a feed tube.

Cap 10 can be formed of polymers or other materials suitable for forming. One method of construction is shown in FIG. 2, wherein the valve housing body is formed in parts for example 20*a*, 20*b* that are connected together and, once assembled, the valve housing is connected to the cover. Connections can be made, for example, by engagement fit, polymeric welding, fusing or adhesives, with consideration to any seals that need be maintained. In another method of construction, the valve housing body can be formed as one part and airway passage 24 can be formed by imbedding or surface mounting a tube, for example a metal tube, to the valve housing body. In such an embodiment, the lateral portion of the air passage ending at opening 50 can be formed by an extension of the tube, by drilling, or by use of pins or plugs in the mold, which lateral portion can be sealed if, by method of manufacture, it opens at the outer surface of the valve housing body. A seal can be provided about the air passage between cover 16 and valve housing body to act against leakage at this interface. In one embodiment, a gasket is formed to incorporate both this seal and the sealing surface of o-ring 46, so that this gasket can replace o-ring 46.

The cap is useful in a liquid dispensing support 60 with a feed tube spike 62 extending upwardly therein. The cap, as disclosed hereinbefore, will remain closed against liquid flow, even when inverted until opened by insertion over feed tube spike 62 and, in particular, pushing port 30 of the cap over feed tube spike 62 in the dispensing support. Feed tube spike 62, thereby pushes on plunger 26 opening the liquid flow passage and air supply passage 24. In this configuration, liquid can flow from the bottle through passage 22, while an air supply can be drawn into the bottle through passage 24. To prevent liquid spillage during this operation, the feed tube spike and o-ring 46 can be co selected to create a seal therebetween. The bottle can be removed from the liquid dispensing support, even when there remains liquid therein, substantially without spilling liquid from the bottle. In particular, when cap 10 is pulled, with the bottle, from feed tube 62, spring 40 will drive the plunger back down to a sealing position both with respect to passage 22 and passage 24. It may be useful to consider the force of spring 40 and the engagement effects of o-ring 46 against feed tube spike 62 to act against the bottle being ejected off the feed tube, by the force in spring. Alternately, other means can be used to ensure that the cap, when desired, remains securely over the feed tube, in spite of the force biasing plunger against the feed tube.

While an embodiment of the invention has been described in detail, this is not intended to be limiting of the claims that follow.

The invention claimed is:

1. A bottle cap for fitting on a bottle including a mouth and an inner volume, the bottle cap comprising: a cover securable over the bottle mouth, the cover having an outer surface and an inner surface; a valve housing extending from the cover inner surface and positioned to be open to the bottle inner volume when the cap is secured over the mouth; a liquid flow port passing through the valve housing and the cover extending between a first opening on the valve housing and a second opening on the cover outer surface; an air supply passage extending between the cover outer surface and the valve housing; a plunger disposed in the valve housing and moveable between a blocking position blocking air flow through the air supply passage and blocking liquid flow from the first opening to the second opening of the liquid flow port and an open position permitting air flow through the air supply passage and liquid flow from the first opening to the second opening of the liquid flow port, the plunger including a drive end accessible though the second port and the plunger being biased into the blocking position but movable into the open position by applying force against the drive end, wherein the second port is sized to fit over a feed tube spike of a liquid dispensing support such that the feed tube spike is employed to apply force against the drive end of the plunger to move the plunger into the open position.

2. The bottle cap of claim 1 wherein the plunger is biased by a spring.

3. The bottle cap of claim 1 further comprising a bore in the valve housing and wherein the plunger is slidably moveable through the bore and driven to slide in the bore when force is applied at the drive end.

4. The bottle cap of claim 3 wherein bore includes a seat against which the plunger is sealed when in the blocking position.

5. The bottle cap of claim 4 wherein the seat is a deformable annular member and the feed tube spike is employable to apply force against the drive end of the plunger and seals to seal against the deformable annular member.

6. A bottle cap comprising: a cap body including a cover surface and a housing, the housing extending opposite the cover surface; a bore in the cap body extending from an opening on the cover surface; a port opening through the housing into the bore; an air supply passage extending between the cover surface and an outer surface of the housing and passing through the bore; and a plunger in the bore and including a drive end accessible through the opening, the plunger being axially moveable along the bore and biased toward the opening but prevented from passing therethrough, the plunger when biased acting to block the air supply passage and to create a seal across the port but drivable by applying force to the drive end to move the plunger axially along the bore to open both the air supply passage and the port, the cap body formed to fit over a mouth of a bottle with the housing extending into the bottle, wherein the opening is sized to fit over a feed tube spike of a liquid dispensing support such that the feed tube spike is employed to apply force against the drive end of the plunger.

7. The bottle cap of claim 6 wherein the plunger is biased by a spring.

8. The bottle cap of claim 6 wherein the plunger is slidably moveable through the bore and driven to slide in the bore when force is applied at the drive end.

9. The bottle cap of claim 8 wherein bore includes a seat against which the plunger is sealed when the plunger is biased with interaction between the plunger and the seat creating the seal across the port.

10. The bottle cap of claim 9 wherein the seat is a deformable annular member and the feed tube spike is employable to apply force against the drive end of the plunger and seals to seal against the deformable annular member.

11. A baffle cap comprising: a cap body including a cover surface and a housing, the housing extending opposite the cover surface and the cap body formed to fit over a mouth of a bottle with the housing extending into the bottle; a liquid flow passage passing through the cap body between a first opening on the housing and a second opening on the cover surface; an air flow passage passing through the cap body separately from the liquid flow passage, the air flow passage extending between an inside opening on the housing and an outside opening on the cover surface; a bore in the cap body and opening at a port on the cover surface and wherein the liquid flow passage passes through the bore and the air flow passage passes through the bore; a valve in the bore operable to control flow through both the liquid flow passage and the air flow passage, the valve being biased to remain in and return to sealing positions relative to the liquid flow passage and the air flow passage in the bore when the valve is not driven to open the liquid flow passage and the air flow passage.

12. The bottle cap of claim 11 wherein the valve is a plunger axially moveable through the bore and including a portion capable of sealing the liquid flow passage and a portion capable of sealing the air flow passage.

13. The bottle cap of claim 11 further comprising an extension tube for extending the length of the air flow passage beyond the inside opening.

* * * * *